US006604390B1

(12) United States Patent
Nooner

(10) Patent No.: US 6,604,390 B1
(45) Date of Patent: Aug. 12, 2003

(54) DEVICE FOR SECURING AN INSULATED CHEST TO A STATIONARY MEMBER

(76) Inventor: Sean Nooner, P.O. Box 444, Hondo, TX (US) 78861

( * ) Notice: Subject to any disclaimer, the term of this patent is extended or adjusted under 35 U.S.C. 154(b) by 0 days.

(21) Appl. No.: 10/056,415

(22) Filed: Jan. 24, 2002

(51) Int. Cl.[7] ..... B65D 55/14

(52) U.S. Cl. ..... 70/63; 70/18; 70/30; 70/49; 109/50

(58) Field of Search ..... 70/14, 18, 30, 70/49, 63, 59, 64; 109/45, 50–52

(56) References Cited

U.S. PATENT DOCUMENTS

| | | | | | |
|---|---|---|---|---|---|
| 924,824 | A | * | 6/1909 | Peebler | 109/50 X |
| 1,352,906 | A | * | 9/1920 | Mamiya | 109/50 X |
| 1,468,991 | A | * | 9/1923 | Butner | 109/50 X |
| 1,643,189 | A | * | 9/1927 | Urovsky | 109/50 X |
| 2,755,748 | A | * | 7/1956 | Abell, Jr. | 109/52 |
| 3,084,008 | A | * | 4/1963 | Mallett | 109/50 X |
| 3,670,535 | A | * | 6/1972 | Stettner et al. | 70/58 |
| 4,474,116 | A | * | 10/1984 | Castenada, Jr. et al. | 109/51 |
| 4,488,624 | A | * | 12/1984 | Myers | 70/49 X |
| 4,756,171 | A | * | 7/1988 | Homar | 70/18 |
| 4,811,577 | A | * | 3/1989 | Webster et al. | 70/49 X |
| 4,907,522 | A | * | 3/1990 | Lutzke | 70/49 X |
| 4,987,836 | A | * | 1/1991 | Owen | 70/63 X |
| 5,156,028 | A | * | 10/1992 | Jiang | 70/30 |
| 5,349,834 | A | * | 9/1994 | Davidge | 70/18 |
| 5,473,917 | A | * | 12/1995 | Say | 70/49 |
| 5,531,082 | A | * | 7/1996 | Wolk et al. | 70/63 |
| 5,531,083 | A | * | 7/1996 | Franck, III et al. | 70/58 |
| 5,595,073 | A | * | 1/1997 | Sullivan | 70/18 |
| 5,768,920 | A | * | 6/1998 | DeBevoise | 70/18 |
| 6,155,715 | A | * | 12/2000 | Lake et al. | 70/64 X |
| 6,192,719 | B1 | * | 2/2001 | Stukas et al. | 70/18 |
| 6,349,575 | B1 | * | 2/2002 | Bentley | 70/18 |

* cited by examiner

*Primary Examiner*—Suzanne Dino Barrett
(74) *Attorney, Agent, or Firm*—Jackson Walker, LLP

(57) ABSTRACT

A device for securing to a chest or stationary member. A chest, such as an ice chest typically includes a lid pivotally mounted to a container. Applicants provide, in a preferred embodiment of Applicant's device, a spool having a retractable cable, the cable having a removed end forming a loop. The lid and the chest have members extending therefrom, which members have a hole at the center thereof. The two members are located such that they are adjacent when the lid is in a closed position. Applicant's also provide a shackle and a lock. When the lid is closed with the two members adjacent one another, the loop at the removed end of the cable may be threaded onto the shackle of the lock. The lid and container mounted members and the shackle of the lock is engaged to the body of the lock so as to prevent the lid from opening. By threading the cable of the spool through or around a stationary member, such as a tree or part of a vehicle, two advantages are achieved—first the unauthorized opening of the lid to acquire access to the items therein and second, prevention of the removal of the chest from the stationary member.

14 Claims, 4 Drawing Sheets

DEVICE FOR SECURING AN INSULATED CHEST TO A STATIONARY MEMBER

FIELD OF THE INVENTION

This invention relates to the field of insulated chest security systems, more specifically the field of a security systems for an insulated chest including a retractable cable capable of engagement with a stationary device and, at a removable end that has been removed, engagement to the insulated chest via a lock.

BACKGROUND INFORMATION

Insulated chests are often transported or left in unattended locations. For example, one might fill an insulated chest with food and place it in the back of a pick-up truck. In the alternative, an insulated chest full of food may be left in a picnic area, temporarily unattended. These scenarios provide an often too tempting ability for others to either steal the insulated chest itself or open the lid and remove the contents.

Therefore, a need exists to provide a simple, inexpensive security system for incorporating into an insulated chest, even during its manufacture or by retrofitting a simple security device which may prevent the unauthorized removal of an insulated chest and, in additional embodiments, also prevent the lid of the insulated chest from being opened.

OBJECTS OF THE INVENTION

Therefore, it is the object of the present invention to provide a simple, inexpensive, easy to install and operate security system whereby an insulated chest may be secured to a stationary member such as a vehicle, a tree, or the like.

SUMMARY OF THE INVENTION

This and other objects are provided for in an approved insulated chest comprising a lid and a container, the insulated chest including a spool with a retractable cable, the cable for engagement with either the lid and/or the container, the cable having a removable end and means for engagement of a removed end to the lid and/or the container.

Applicant also provides for this and other objects of the invention in providing an improved insulated chest having a retractable spool incorporated therein, the retractable spool including a cable having a removable end, and a lock for securing the removed end of the cable when in the extended position to the lid and/or the container of the insulated chest.

DETAILED DESCRIPTION OF THE PREFERRED EMBODIMENT

Figure 1:
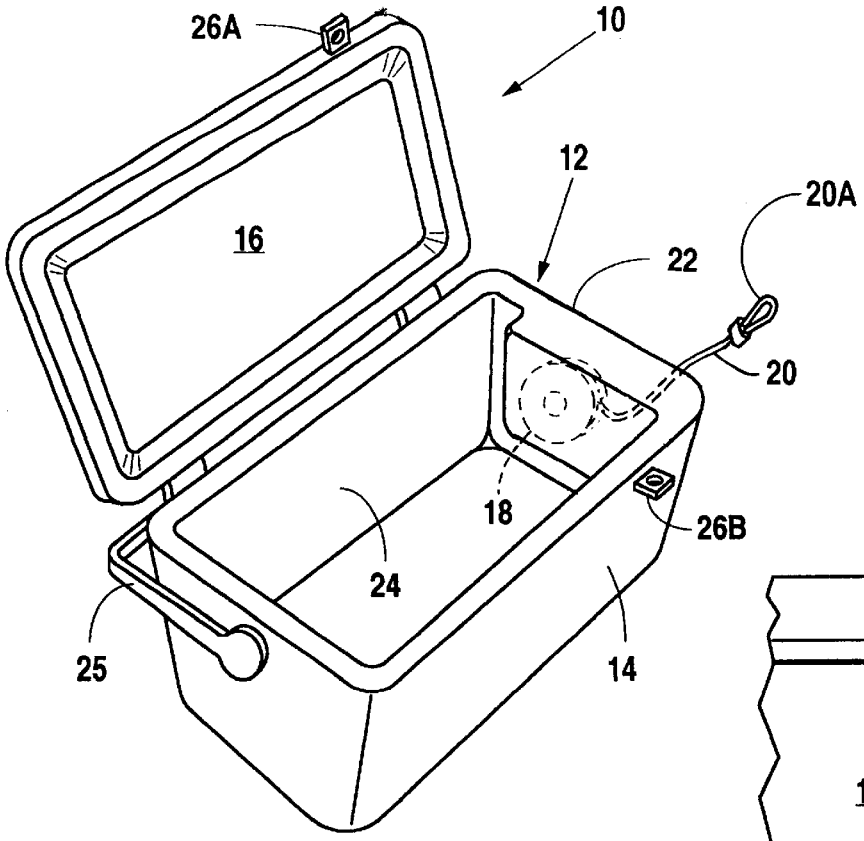
FIG. 1 is a isometric view of Applicant's system illustrating an insulated chest having a container portion and a lid portion with a spool built into a side: wall of the container.
Figure 1B:
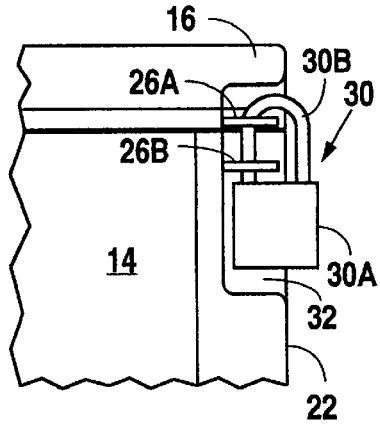
FIG. 1B is a cut away view of a portion of the lid and container illustrating the manner in which a lock may be used to secure the lid to the container of the insulated chest.
Figure 1A:
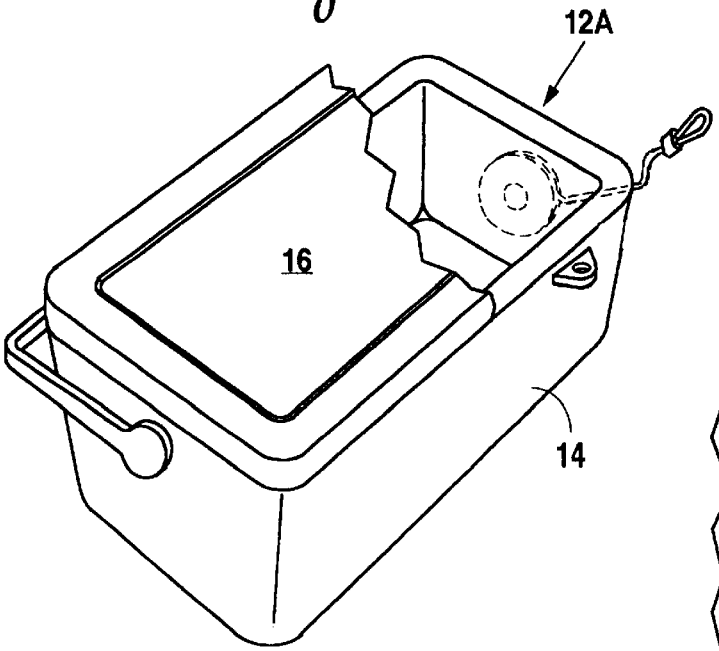
FIG. 1A is a isometric view of Applicant's system illustrating an insulated chest having a container portion and a lid portion with a spool built into a side wall of the container, the container having side walls of uniform thickness.
Figure 2:
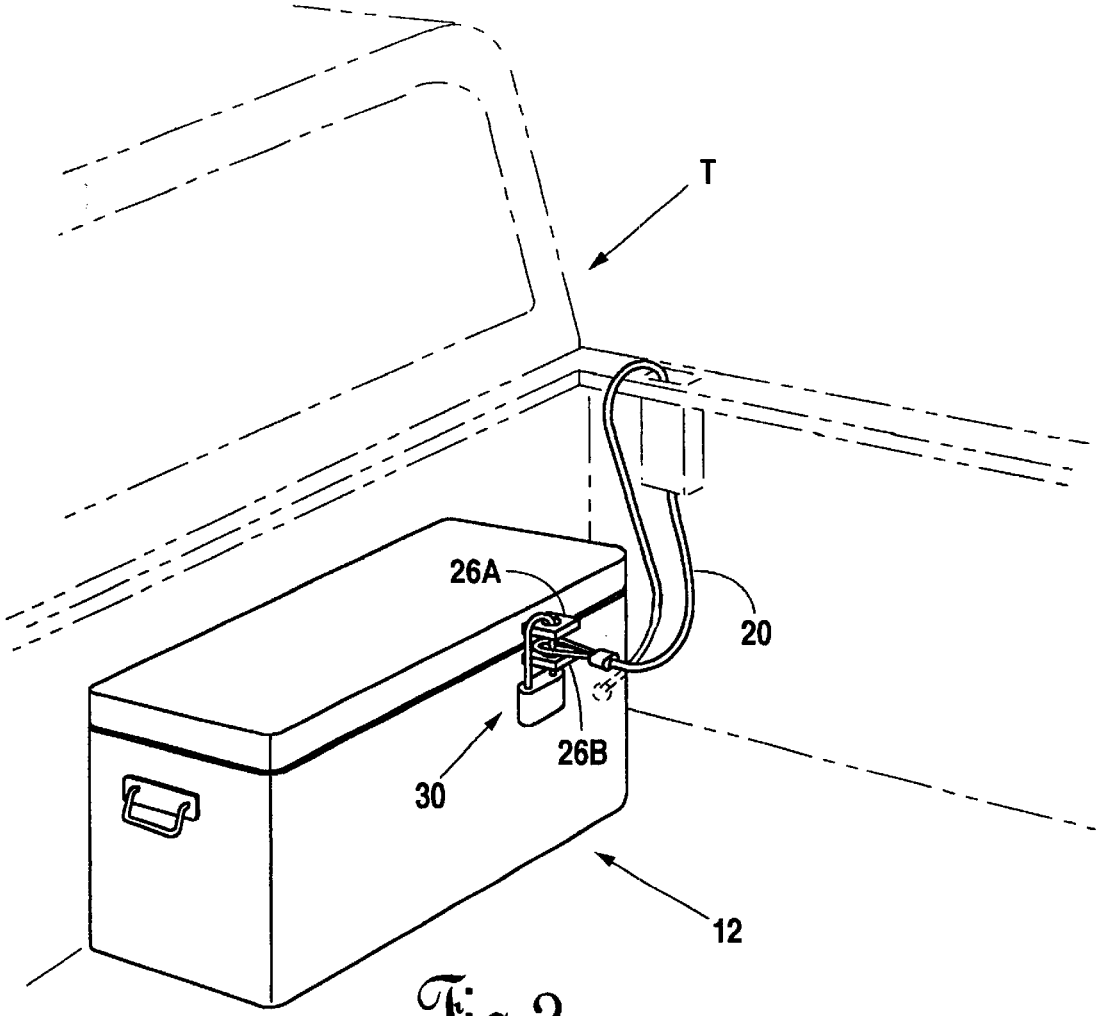
FIG. 2 is an isometric view of the manner in which Applicant's cable having a removable end is used to engage with the shackle of a lock as the shackle of the lock also engages members mounted to the lid and the container of the insulated chest.
Figure 6:
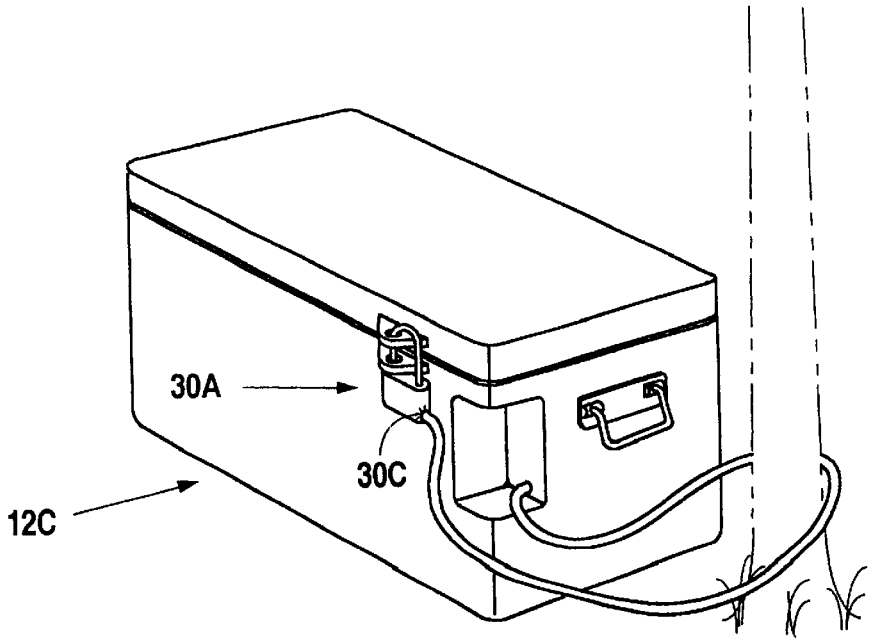
FIG. 6 illustrates an isometric view of an alternate preferred embodiment of Applicant's present invention having the removable end of the cable attached to the body of the lock.

FIGS. 1 and 1A illustrate Applicant's novel system (10) for securing an insulated chest to a stationary member, such as a tree, part of a building or a part of a vehicle (see for example, FIGS. 2 and 6). It is seen with reference to the Figures that Applicant's system includes a an insulated chest (12) typically comprised of two elements, a container portion (14) which typically consists of a bottom wall, side walls, and a lid portion (16), typically pivotally connected to the container portion so as to closably seal the top thereof to prevent access to the container and to maintain the contents of the insulated chest at a temperature lower than ambient. Applicant provides for novelty in securing to the insulated chest (12) a spool (18), the spool including a flexible cable (20).

Figure 5:
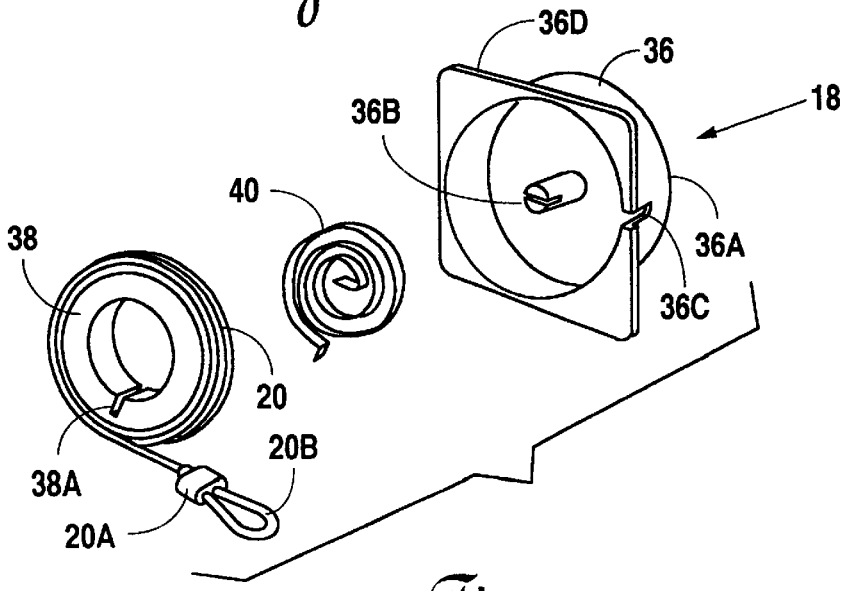
FIG. 5 is an exploded isometric view of the spool illustrating the manner in which a reel housing is used to engage a reel mounted cable, with a biased spring between the reel and the reel housing.

Spool (18) is secured to the insulated chest, and the cable is secured to a reel (38) as seen in FIG. 5, the reel being biased so as to draw the cable onto the reel (38) of the spool (18).

It is seen that cable (20) of the spool (18) includes a removable end (20A). Here the removable end forms a loop member, and the removable end is located outside the interior portions of the chest. Locating removable end (20A) may be accomplished by providing an appropriately dimensioned hole in an exterior side wall (22) of the container of the insulated chest as seen in FIGS. 1 and 2. Locating removable end (20A) outside of the interior portion of the container may be accomplished by mounting the spool (18), such as by rivets (34) (see FIG. 7), adhesives, or the like, to the exterior walls of the insulated chest. In any case, the spool is rigidly secured to the insulated chest with the removable end (20A) of the spool (18), typically a loop member accessible from outside the insulated chest when the lid is in a closed or "down" position.

Figure 8:
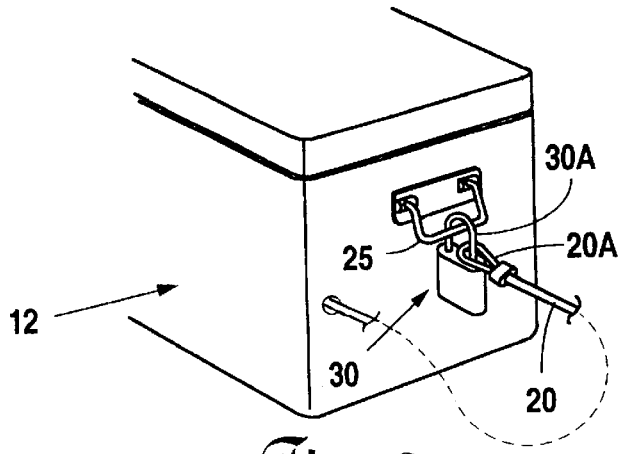
FIG. 8 is an alternate preferred embodiment of Applicant's present invention which uses an existing handle on the container of the insulated chest to secure the removed end of the cable to the handle.

Exterior walls (22) of the container may have a handle (25) attached thereto (see FIGS. 1 and 8). The container typically includes interior walls (24). It is customary in an insulated chest to have a container (14) with the interior walls (24) separated by some distance from the exterior walls (22) of the container, so as to provide effective insulation. Applicant provides for two embodiments (12 and 12A) of insulated chest, embodiment (12) in FIG. 1 illustrating a spool (18) mounted within the walls of the container with the walls modified and dimensioned to be wider apart in the space where the spool is located. However, an appropriately dimensioned spool may be mounted between the walls of a container as illustrated in FIG. 1A while maintaining the uniform distance between the interior and exterior walls of the container. Mounting of the spool (18) within the walls may be done by adhesives, rivets or fasteners known in the trade.

Turning now to FIGS. 1, 1A, 1B and 1C, it is seen that. Applicant's invention includes a pair of shackle receiving arms (26A and 26B) (see FIG. 1) which arms are mounted to lid (16) and the container (14) in a manner such that closing lid (16) of the chest will place the two shackle receiving arms (26A and 26B) adjacent one another. Applicant's invention also includes a lock (30), the lock (30) being typical of locks having a body (30A), typical rectangular, and a body engaging, slideable shackle (30B), such locks being activated, for example by either a key or a combination dial incorporated into the body of the lock. Further, it is seen with reference to FIGS. 1B, 1C and FIG. 2 that when the pair shackle arms are adjacent one another, the lid being in a closed position, the shackle of the lock may engage both the two shackle engaging arms as well as the loop member at the removed end of the cable to achieve two functions. The first function is to prevent the opening of the lid of the chest and the unauthorized removal of the contents thereof. The second function is achieved by threading the cable, before securement to the shackle, through a stationary member (for example, of a moving vehicle, such as truck T in FIG. 2) or, for example around a tree such as illustrated in FIG. 6. This achieves a second purpose of Applicant's system, preventing removed of the chest from a stationary member.

FIG. 1B illustrates that exterior walls (22) of container may include a cutout (32) for receiving part or all of lock (30) there within when the lock is securing the chest to a stationary member and, here where the lock is also securing the lid in a down or closed position.

Figure 1C:
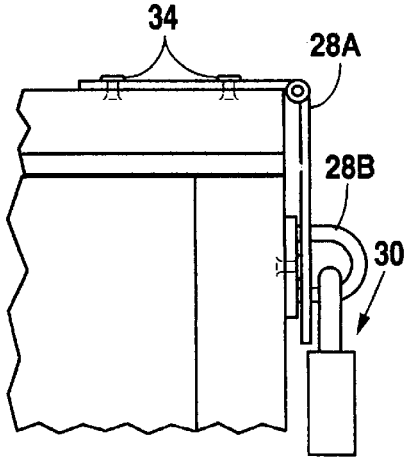
FIG. 1C is alternate preferred embodiment of shackle receiving means, for securing a lid the container as well as securing a container to a stationary object.

FIG. 1C illustrates that Applicant may provide other structural members which will functionally secure the lid to the container through the use of a lock having a shackle, here a slotted hinged plate (28A) which may be secured to the lid and/or the sidewalls through rivets (34). "U" member plate (28B) is dimensioned for receipt within the slot of a hinged plate when the hinged plate is folded against the "U" member plate such that a shackle of lock (30) may be engaged therewith and with the loop member at removed end (20A) of the cable to secure the lid in a down or closed position and secure simultaneously the entire chest to a stationary member.

FIG. 2 illustrates an embodiment of Applicant's system in use secured to a truck through the use of paired shackle receiving arms (26A and 26) and lock (30) having a shackle threaded through the two arms and the removed end of the cable.

Figure 3:
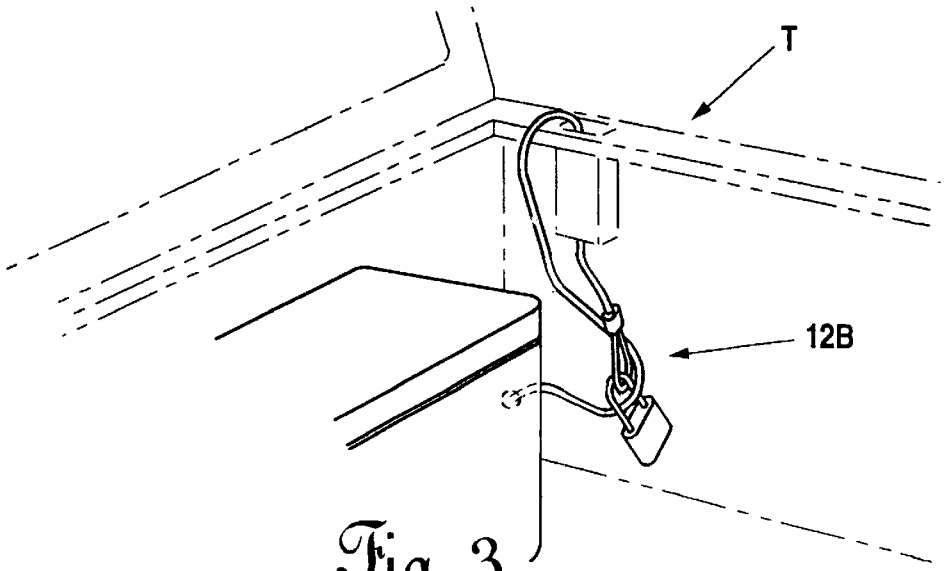
FIG. 3 is an isometric illustration of an alternate preferred embodiment of Applicant's invention which does not require the use of shackle engaging arms.

FIG. 3 illustrates an alternate preferred embodiment of Applicant's present invention whereby no shackle receiving means is provided, security for unauthorized removal of the insulated chest being provided and no means for securing the lid of the insulated chest to the container of the insulated chest. Here it is seen that the loop at the removed end is threaded back through the stationary member and onto the cable, secured only by the shackle of the lock.

Figure 4:
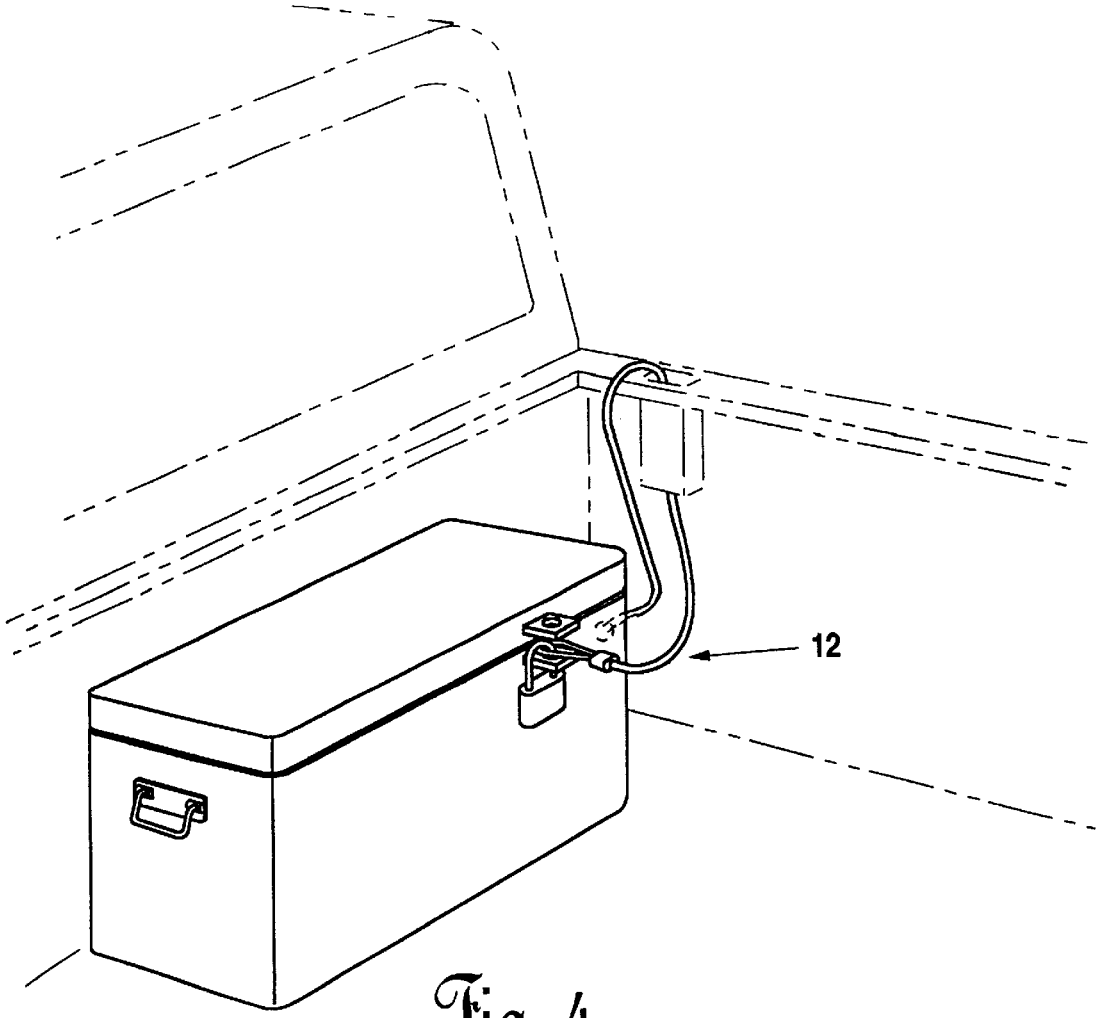
FIG. 4 is an alternate means of securing the insulated chest in the embodiment illustrated in FIG. 2.

FIG. 4 illustrates that Applicant's novel invention may be used for securing only the container of the insulated chest, allowing the lid to be free to be raised and lowered for convenient access to the items within. In this embodiment, the shackle of the lock is threaded through a shackle engaging arm fixedly attached to the container and through the loop at the removed end of the cable.

FIG. 5 provides illustration of a spool having a retractable reel for use with the present invention. It is seen that spool (18) may include a reel housing (36) for enclosing a reel (38) therein as well as spring (40). The reel housing includes a recessed portion (36A) for receipt of a reel, having cable (20) wound thereupon. Cable and reel may be inserted into the reel housing. A mounting post (36B) having a slot therein as well as a spring slot (38A) adjacent the inner circumference of the reel will each receive an end of spring (40) which then will be wound with a cable thereon. A cable slot (36C) in reel housing (36) may be provided so that the removed end of the reel, which may contain a swag (20B) can be placed so that the removed end does not wind back into the reel housing. Reel housing (36) may contain mounting flange (36D) as part thereof which will allow the spool to be mounted anywhere on the lid or container, interior or exterior surfaces by any convenient means, such as fasteners including rivets or adhesives such as epoxy.

Figure 7:
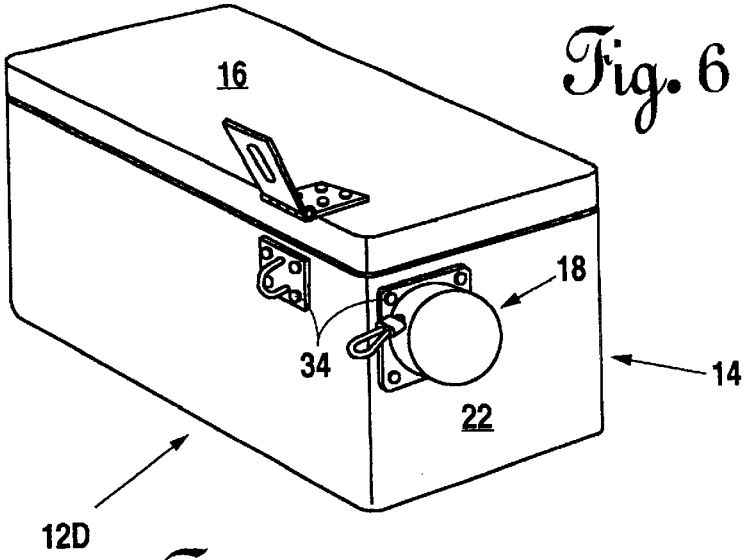
FIG. 7 is an isometric view of alternate preferred embodiment of Applicant's present invention with the spool attached to an exterior wall of the container as by adhesives or fasteners.

FIG. 7, for instance illustrates the manner of Applicant's novel invention including spool (18) being permanently secured to a portion of the exterior walls (22) of the container of an insulated ice chest, this embodiment being referenced as embodiment (12D). Rivets (34) engage mounting flange (36D) and the exterior walls to permanently attach the spool to the container.

FIG. 6 illustrates an embodiment of Applicant's present invention in which the removable end of the cable is adapted to be permanently secured to body (30A) of lock (30) such as by a weld (30C). In the illustrated embodiment (12C), a corner of the insulated chest is cut away to permit storage of lock (30) when the cable is retracted, and the removable end of the cable is integral with a lock to secure the cable to a stationary member, such as the tree illustrated, and then to the container as illustrated in FIG. 6.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall which the scope of the invention.

I claim:

1. A system for securing an insulated chest, the insulated chest having exterior walls, to a stationary member, the insulated chest including a lid and a container portion, the system comprising:

a retractable spool capable of engagement with a side wall of the insulated chest, the retractable spool including a cable having a removable end emanating from a hole in said side wall, the retractable spool for biasing the cable to a retracted position from an extended position, the extended position for positioning the cable about the stationary member, the retracted position for positioning the removed end of the cable adjacent to a wall of the insulated chest;

shackle engaging means; and a lock, the lock including a body and shackle capable of engaging both the shackle engaging means and the removed end of the cable, when the cable is in the extended position, to secure the insulated chest to the stationary member.

2. The system of claim 1 wherein the shackle engaging means includes a handle, the handle attached to a wall of the insulated chest.

3. The system of claim 1 wherein the shackle engaging means includes at least one shackle receiving arm.

4. The system of claim 1 wherein the shackle engaging means includes a multiplicity of shackle receiving arms.

5. The system of claim 4 wherein the multiplicity of shackle receiving arms includes a pair of shackle receiving arms, one of the arms mounted to the lid, the second of the arms to the container.

6. The system of claim 5 wherein the pair of shackle receiving arms is mounted such that when the lid is in a closed position adjacent the container, the pair of shackle engagement arms are adjacent one another.

7. The system of claim 3 wherein at least one shackle receiving arm is hinged.

8. The system of claim 1 further including means to mount the spool to the container.

9. The system of claim 8 wherein means to mount the spool is capable of mounting the spool to a wall of the container.

10. The system of claim 8 wherein the means to mount the spool is capable of mounting the spool between an exterior and an interior wall of the container.

11. The system of claim 1 further including means to mount the spool to the lid of the container.

12. The system of claim 1 wherein the cable of the retractable spool is steel and includes a sheath.

13. The system of claim 1 further including means to engage the cable of the spool to the shackle.

14. The system of claim 1 further including means to permanently engage the cable to the body of the lock.

* * * * *